US006073348A

United States Patent [19]

Shiba

[11] Patent Number: 6,073,348

[45] Date of Patent: Jun. 13, 2000

[54] RECIPROCATING ELECTRIC SHAVER

[75] Inventor: Takeshi Shiba, Osaka, Japan

[73] Assignee: Matsushita Electric Works, Ltd., Osaka, Japan

[21] Appl. No.: 09/123,458

[22] Filed: Jul. 28, 1998

[30] Foreign Application Priority Data

Jul. 28, 1997 [JP] Japan ..... 9-218269

[51] Int. Cl.[7] ..... B26B 19/42

[52] U.S. Cl. ..... 30/34.1; 30/43.92

[58] Field of Search ..... 30/34.1, 34.2, 30/43.1, 43.2, 43.92

[56] References Cited

U.S. PATENT DOCUMENTS

| | | | |
|---|---|---|---|
| 2,467,417 | 4/1949 | Wurtele | 30/43.1 |
| 2,629,169 | 2/1953 | Kleinman | 30/43.2 |
| 2,734,266 | 2/1956 | Schreyer | 30/43.2 |
| 3,136,055 | 6/1964 | Kobler et al. | 30/43.1 |
| 3,339,276 | 9/1967 | Tolmie et al. | 30/34.1 |
| 3,827,144 | 8/1974 | Arpino | 30/43.2 |
| 4,866,843 | 9/1989 | Kumano | 30/34.1 |
| 4,926,552 | 5/1990 | Otsuka et al. | 30/43.92 |
| 5,189,792 | 3/1993 | Otsuka et al. | 30/43.92 |
| 5,398,412 | 3/1995 | Tanahashi et al. | 30/43.92 |
| 5,490,328 | 2/1996 | Ueda et al. | 30/43.92 |
| 5,551,154 | 9/1996 | Tanahashi et al. | 30/43.92 |
| 5,678,313 | 10/1997 | Tezuka et al. | 30/43.92 |
| 5,706,582 | 1/1998 | Hosokawa et al. | 30/34.2 |

FOREIGN PATENT DOCUMENTS 8-323063 12/1996 Japan .

OTHER PUBLICATIONS

Abstracts of Japan, vol. 097, No. 004, Apr. 30, 1997, JP 08 323063, Dec. 10, 1996.

*Primary Examiner*—Rinaldi I. Rada
*Assistant Examiner*—Kim Ngoc Tran
*Attorney, Agent, or Firm*—Oblon, Spivak, McClelland, Maier & Neustadt, P.C.

[57] ABSTRACT

A reciprocating electric shaver including a main body, plural blade cassettes and a retainer. Each of the plural blade cassettes includes an outer blade and an outer blade frame to which the outer blade is attached. The outer blade frame has engaging members at end portions in a longitudinal direction substantially perpendicular to an arranging direction of the plural blade cassettes. The plural blade cassettes are attached to the main body via the retainer. The retainer has a pair of end walls substantially parallel to the arranging direction. Each of the pair of end walls has slits extending along a floating direction substantially perpendicular to the longitudinal direction and to the arranging direction. The retainer retains the plural blade cassettes substantially in parallel each other by introducing the engaging members into the slits respectively such that each of the plural blade cassettes is independently movable along the floating direction with respect to the main body and such that the outer blade frame of each of the blade cassettes covers an outer periphery of the retainer.

9 Claims, 13 Drawing Sheets

10
10
11
11
13
1
180
12
21
25
22
20
210
45
54
56
2
16
15
14
180
1
13
180
17
14
180
12
21
210
45
33
33
33
3
33
33
33
48
48
46
49
47
48
49
46

RECIPROCATING ELECTRIC SHAVER

BACKGROUND OF THE INVENTION

1. Field of the Invention

The present invention relates to a reciprocating electric shaver including plural blade cassettes arranged in parallel to be independently movable with respect to a main body of the shaver.

2. Description of the Related Art

In the present application, priority under 35 U.S.C. 119 is requested based on Japanese Patent Application No. 9-218,269, filed Jul. 28, 1997, entitled "Reciprocating Electric Shaver". The contents of that application are incorporated herein by reference.

A reciprocating electric shaver is disclosed in Japanese Unexamined Patent Publication (kokai) 8-323,063, entitled "Electric Shaver". The contents of that application are incorporated herein by reference. In this shaver, each of blade cassettes includes an outer blade and an outer blade frame to which the outer blade is attached. Plural blade cassettes are arranged substantially in parallel to be movable with respect to a main body of the shaver in order to improve the shaving efficiency by fully contacting each of the outer blades with skin. In this shaver, the blade cassettes are arranged inside a periphery of a retainer via which the blade cassettes are attached to the main body.

In this shaver, the strength of the shaver against outside force is improved since the blade cassettes are protected by the retainer. However, upon shaving while looking at a mirror, the floating situation of each of the blade cassettes cannot be checked since the blade cassettes are covered by the retainer. Accordingly, the position of the shaver cannot be adjusted such that each of the outer blades of the blade cassettes is properly in contact with skin.

On the other hand, if the blades cassettes are attached to the retainer to cover the retainer, the floating situation of each of the blade cassettes can be easily checked. However, in the shaver in which the plural blade cassettes are arranged in parallel, each of the plural blade cassettes cannot cover the entire periphery of the retainer. Accordingly, when force is applied to the blades cassettes outwardly to remove the blade cassettes from the retainer, the blade cassettes are easily removed from the retainer. Such a force is always applied to the plural blade cassettes while shaving.

SUMMARY OF THE INVENTION

An object of the present invention is to provide a reciprocating electric shaver in which the floating situation of each of the plural blade cassettes can be easily checked and in which the plural blade cassettes can be firmly attached to the retainer.

The object is achieved according to the present invention by providing a new reciprocating electric shaver including a main body, plural blade cassettes and a retainer. Each of the plural blade cassettes includes an outer blade and an outer blade frame to which the outer blade is attached. The outer blade frame has engaging members at end portions in a longitudinal direction substantially perpendicular to an arranging direction of the plural blade cassettes. The plural blade cassettes are attached to the main body via the retainer. The retainer has a pair of end walls substantially parallel to the arranging direction. Each of the pair of end walls has slits extending along a floating direction substantially perpendicular to the longitudinal direction and to the arranging direction. The retainer retains the plural blade cassettes substantially in parallel each other by introducing the engaging members into the slits respectively such that each of the plural blade cassettes is independently movable along the floating direction with respect to the main body and such that the outer blade frame of each of the blade cassettes covers an outer periphery of the retainer.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE PREFERRED EMBODIMENTS

Figure 1:
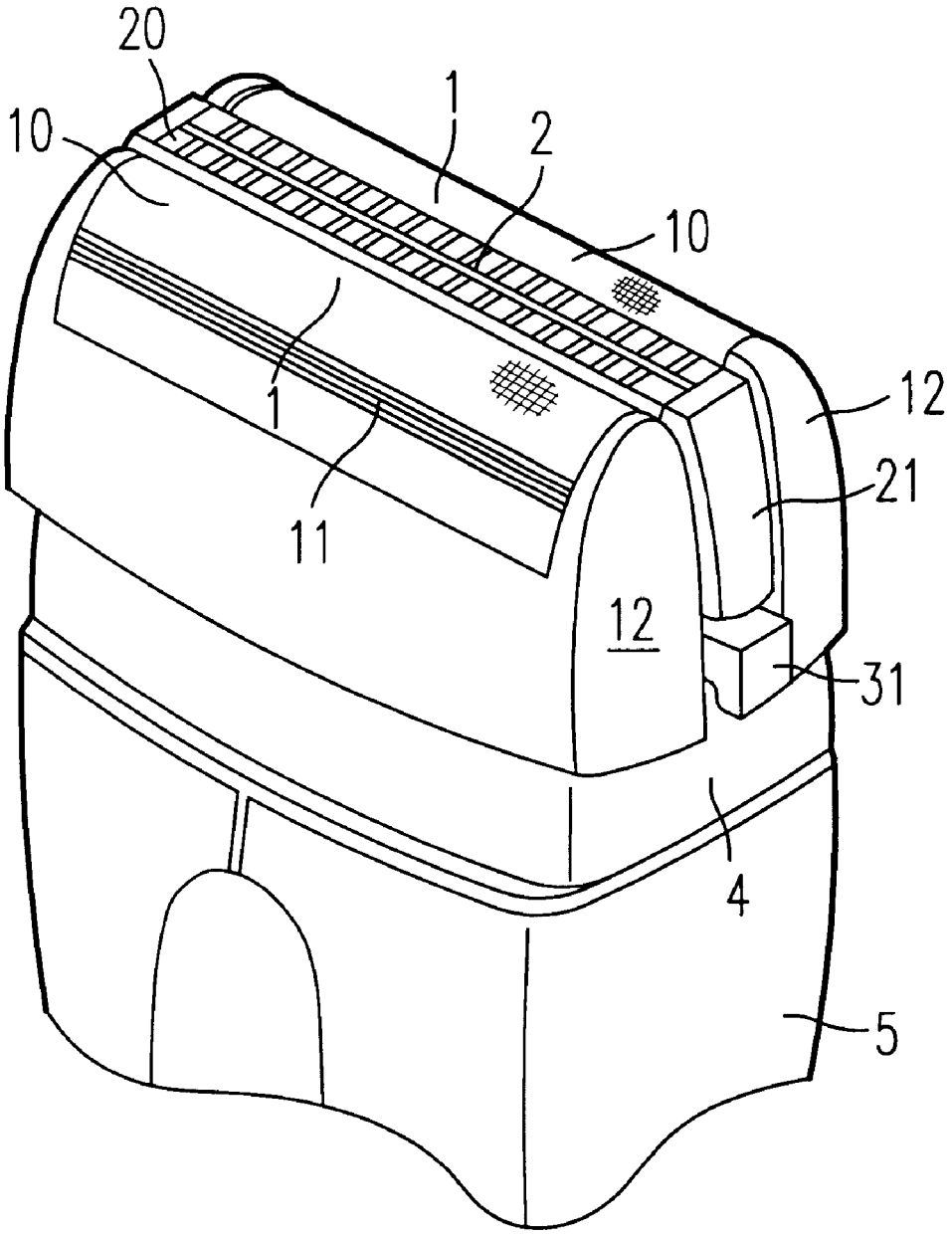
FIG. 1 is a perspective view of a reciprocating electric shaver according to a first embodiment of the present invention.

The preferred embodiments will now be described with reference to the accompanying drawings, wherein like reference numerals designate corresponding or identical elements throughout the various illustrations.

Figure 2:
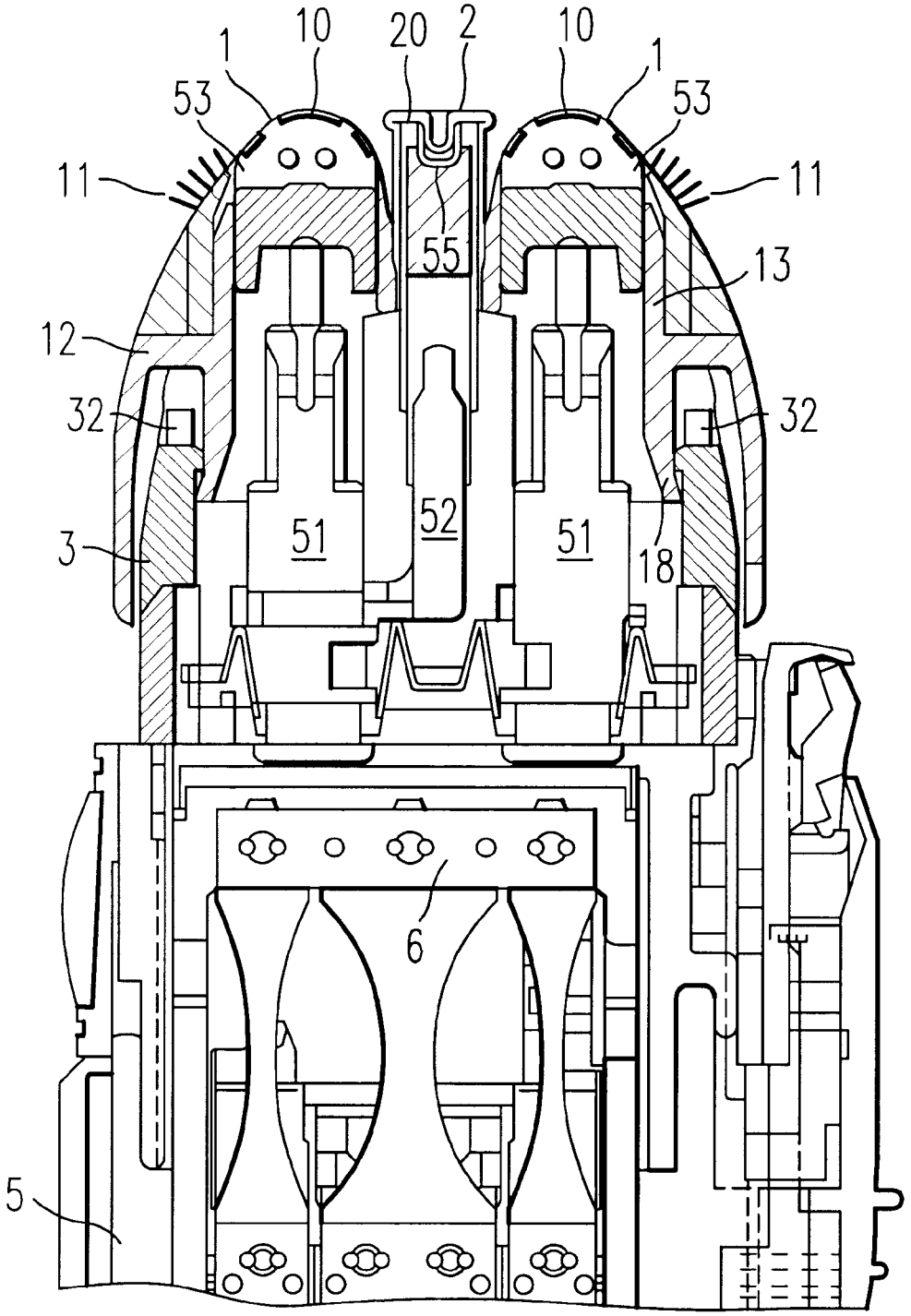
FIG. 2 is a sectional view of the reciprocating electric shaver according to the first embodiment of the present invention.

FIG. 1 shows a perspective view of a reciprocating electric shaver according to a first embodiment of the present invention. FIG. 2 shows a sectional view of the reciprocating electric shaver according to the first embodiment of the present invention. Referring to FIGS. 1 and 2, the reciprocating electric shaver has a pair of blade cassettes 1 and 1, and a center blade cassette 2. The center blade cassette 2 is arranged between the pair of blade cassettes 1 and 1 such that longitudinal directions of the blade cassettes 1, 1 and the center blade cassette 2 are substantially in parallel. Each of the blade cassettes 1, 1 and the center blade cassette 2 is independently movable. The blade cassettes 1, 1 and the center blade cassette 2 have outer blades 10, 10 and 20 and inner blades 53, 53 and 55 respectively. Each of the inner blades 53, 53 and 55 are arranged to face each of the outer blades 10, 10 and 20. A linear motor 6 drives the inner blades 53, 53 and 55 reciprocally.

Figure 3:
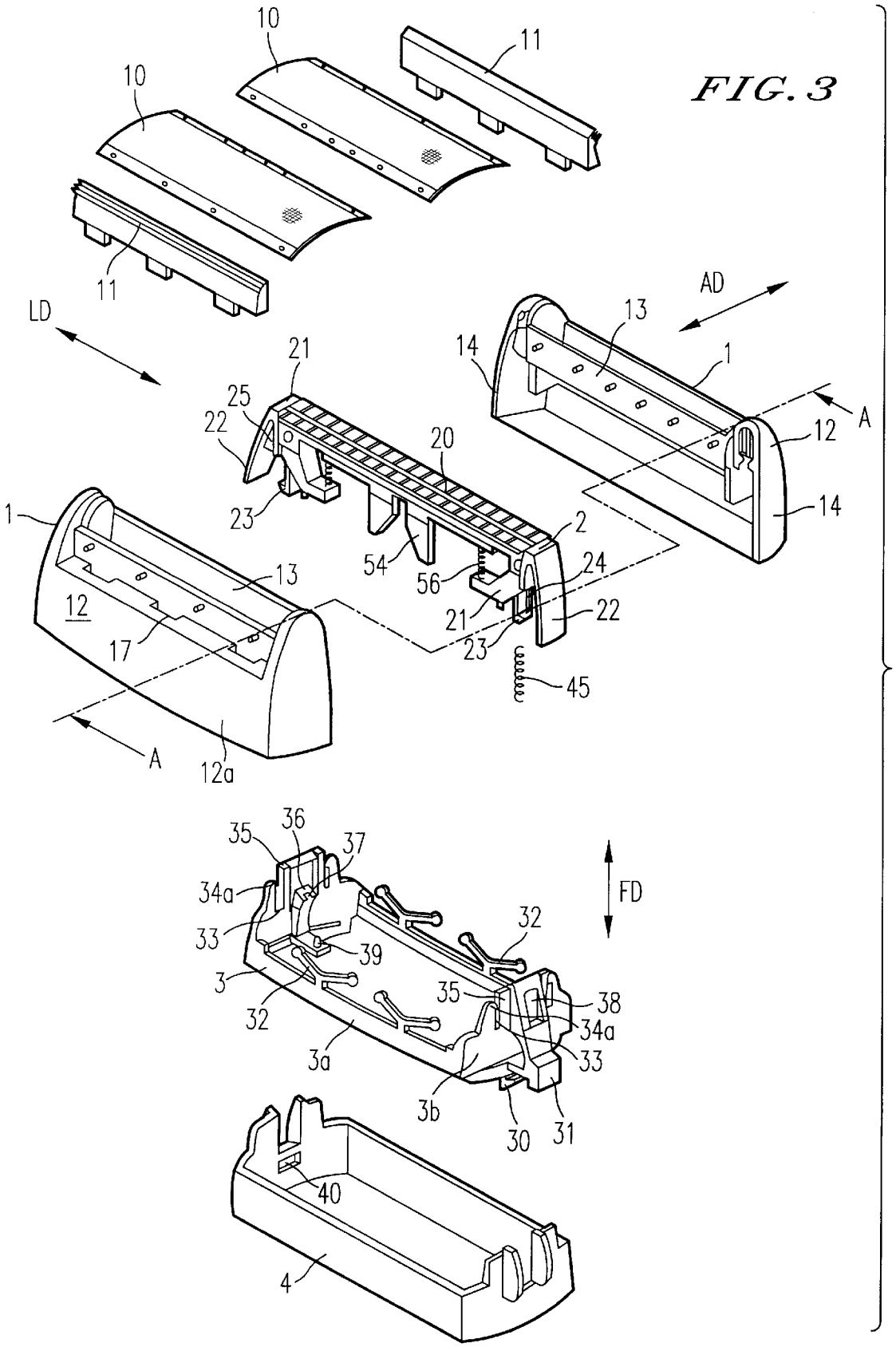
FIG. 3 is an exploded perspective view of the reciprocating electric shaver according to the first embodiment of the present invention.

FIG. 3 shows an exploded perspective view of the shaver. Referring to FIG. 3, the blade cassette 1 includes an outer blade frame 12, the outer blade 10 and a stretching member 11 for stretching skin in order to raise hair by stretching skin. The outer blade frame 12 is made from synthetic resin and has an attachment frame 13 which is formed integrally with the outer blade frame 12 inside the outer blade frame 12. The outer blade 10 is attached to both longitudinal side walls of the attachment frame 13 extending longitudinal direction (LD) thereof. The stretching member 11 has thin elastic ribs and is inserted into attaching holes 17 provided in the outer blade frame 12. The longitudinal side wall (12*a*) of the outer blade frame 12 and both end walls 14 substantially perpendicular to the longitudinal side wall (12*a*) extend beyond the lower end of the attachment frame 13.

Figure 4:
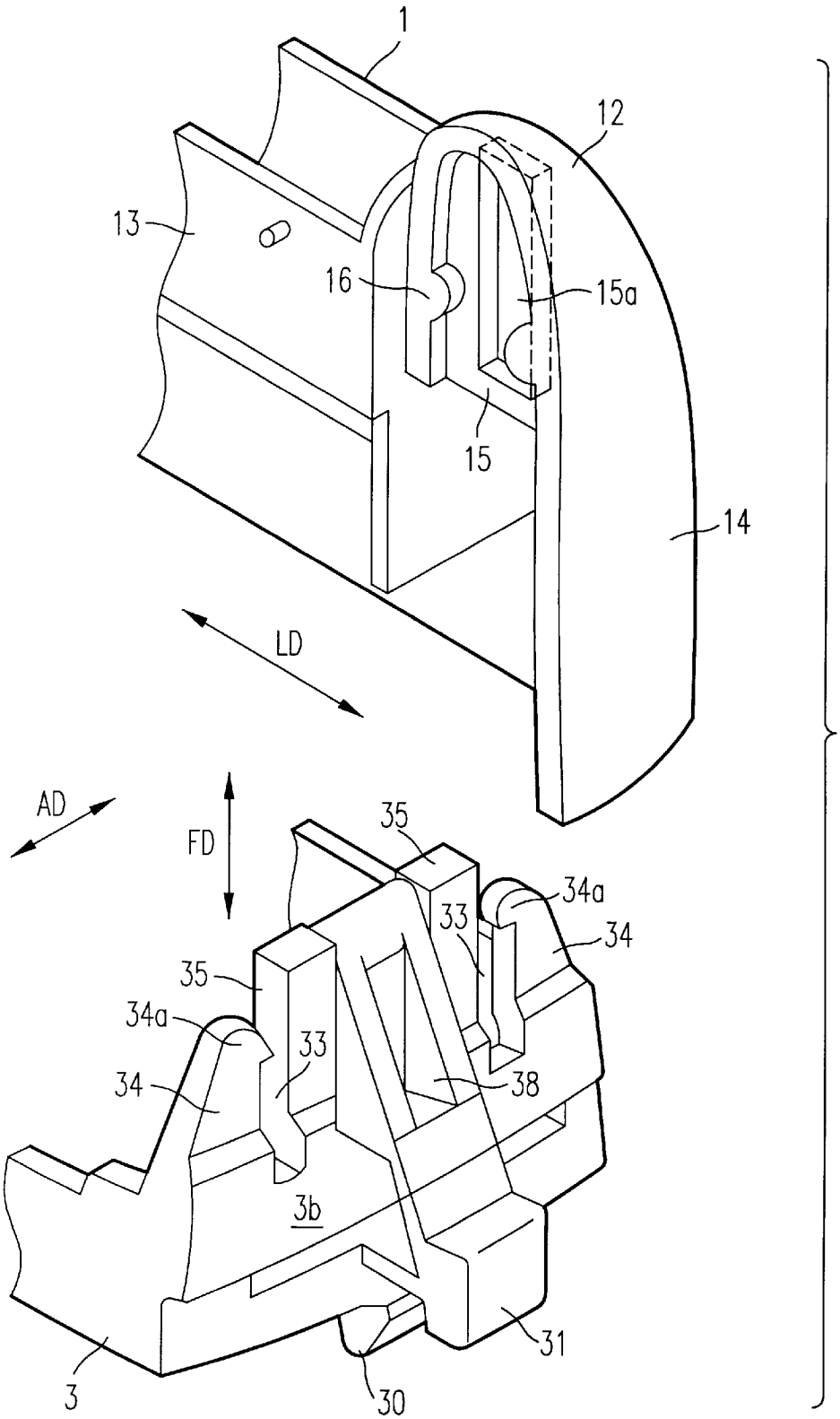
FIG. 4 is an enlarged perspective view of an essential portion of the reciprocating electric shaver according to the first embodiment of the present invention.

Referring to FIG. 4, outer surfaces of both ends of the attachment frame 13 in the longitudinal direction (LD) thereof are connected to the inner surfaces of the end walls 14 of the outer blade frame 12 by engaging members 15. Further, projections 16 are projected from the outer surfaces of both ends of the attachment frame 13 in the longitudinal direction (LD) thereof and the inner surfaces of the end walls 14 of the outer blade frame 12, respectively.

Figure 5:
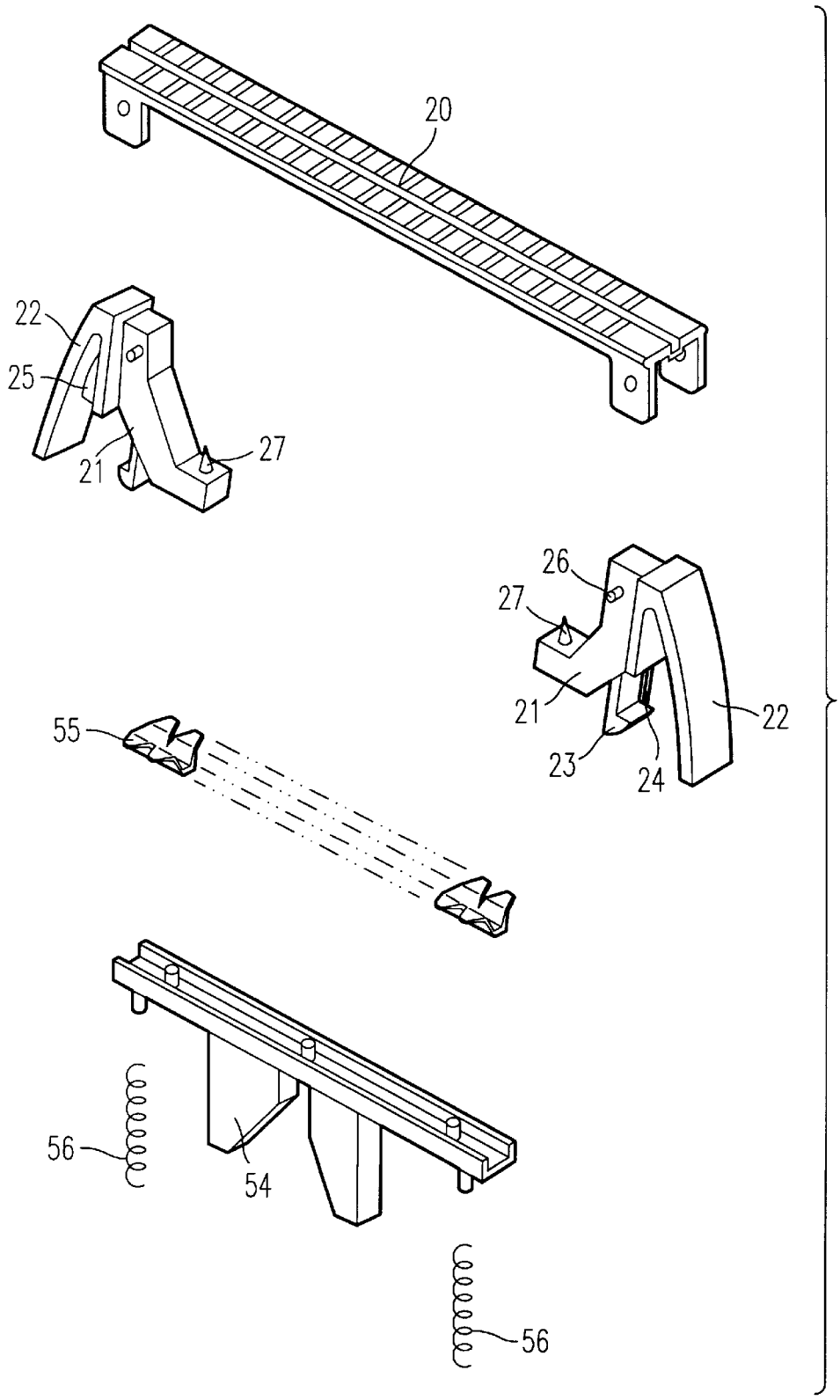
FIG. 5 is an exploded perspective view of the center blade cassette of the reciprocating electric shaver according to the first embodiment of the present invention.
Figure 6:
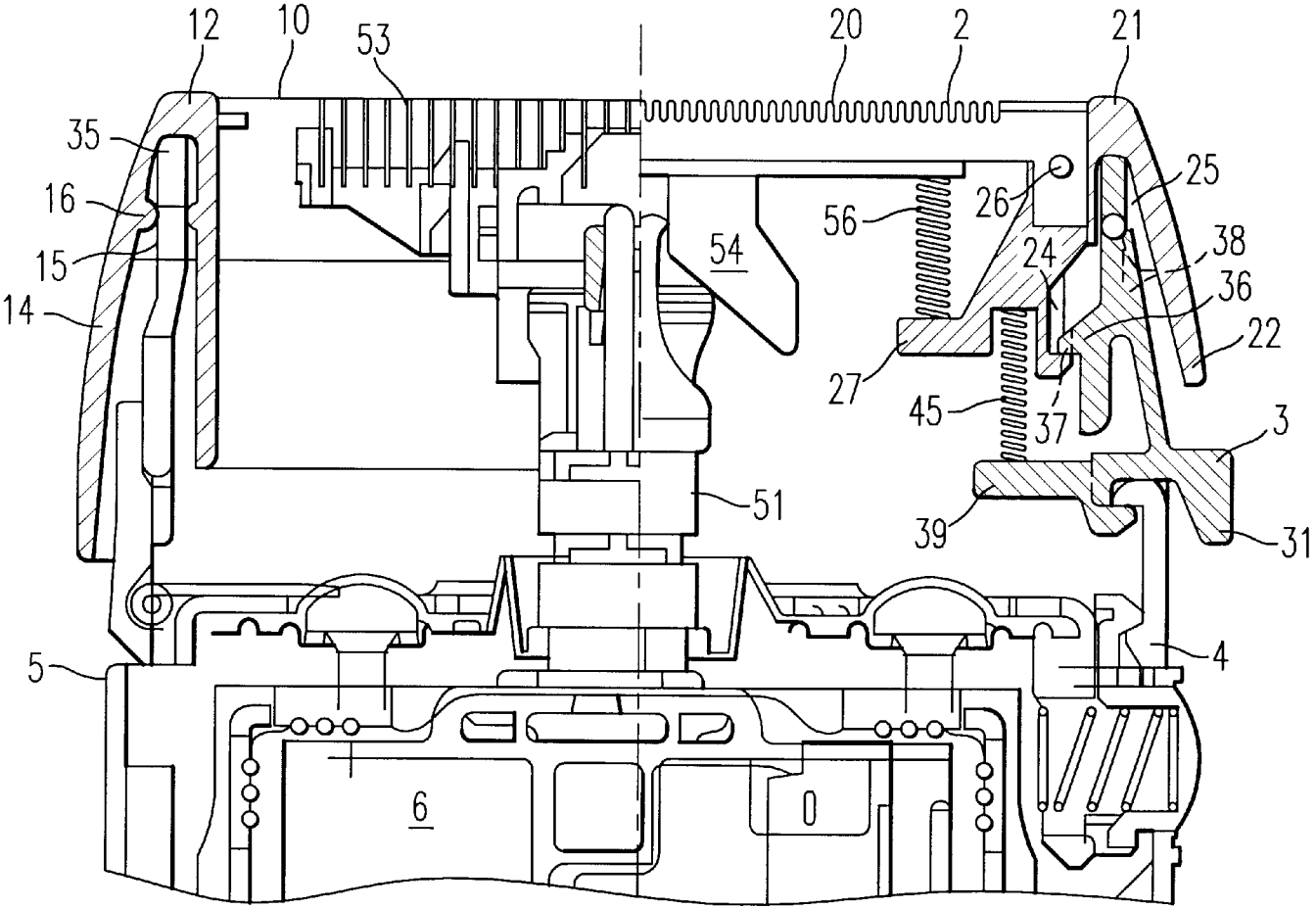
FIG. 6 is a sectional view of the reciprocating electric shaver according to the first embodiment of the present invention.

Referring to FIGS. 3, 5 and 6, the center blade cassette 2 has the outer blade 20 which is so called as a "slit blade". The outer blade 20 is attached to supports 21 at the both longitudinal ends of the outer blade 20 via bosses 26 provided on the supports 21. These supports 21 are made from synthetic resin. The support 21 has a spring receiving portion 27 on its inner side, a cover 22 on the outer side, a longitudinal rib 25 inside the cover 22 and a hook 23 projecting downwardly in FIG. 5. The hook 23 includes a vertical rib 24. The inner blade 55 is attached to a joint 54 to be slidable on the inner surface of the outer blade 20. Springs 56 are arranged between the spring receiving portions 27 and both longitudinal ends of the joint 54. Accordingly, the inner blade 55 is urged to the outer blade 20.

Figure 12:
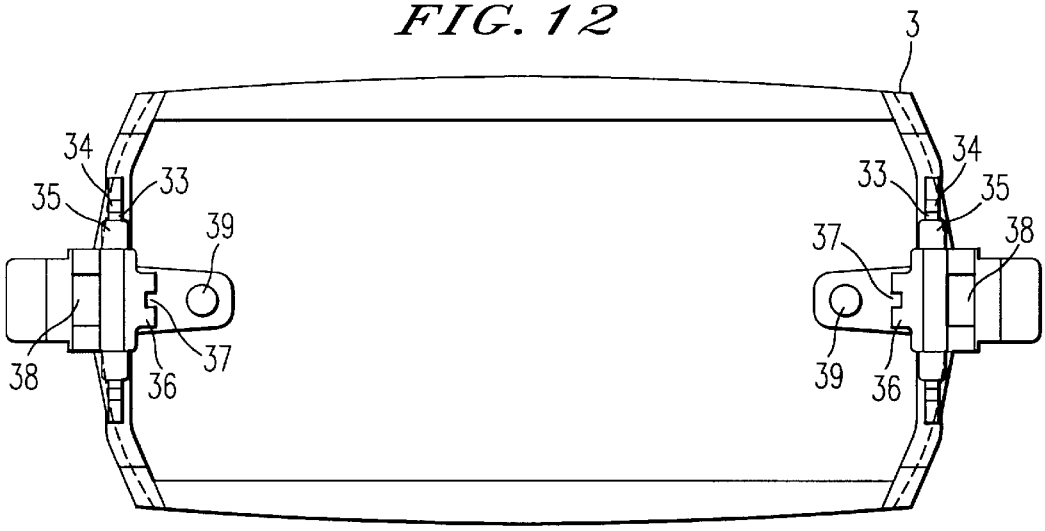
FIG. 12 is a plan view of a retainer of the reciprocating electric shaver.

Referring to FIGS. 1–3, the blade cassettes 1, 1 and the center blade cassette 2 are mounted on a main body 5 via a retainer 3 and an head support 4. The main body 5 contains the linear motor 6. The retainer 3 is made from synthetic resin. As shown in FIG. 3, float spring portions 32 are projected upwardly from the upper portions of longitudinal walls (3*a*) of the retainer 3 and hooks 30 are projected downwardly from the lower portions of end walls (3*b*) substantially perpendicular to the longitudinal walls (3*a*). As shown in FIGS. 4 and 12, a pair of vertical slits 33 opened upwardly are provided between a side wall 34 and a guide wall 35 in the end wall (3*b*). The slits 33 extend along a floating direction (FD) substantially perpendicular to the longitudinal direction (LD) of the attachment frame 13 or the outer blade frame 12 and an arranging direction (AD) of blade cassettes 1, 1 and the center blade cassette 2. A hook (34*a*) is provided on the top portion of the side wall 34. Further, a vertical groove 38 is provided at the upper center portion of the end wall (3*b*) between the pair of vertical slits 33, and a pushing portion 31 having the hook 30 inside the pushing portion 31 is provided at the lower center portion of the end wall (3*b*) between the pair of vertical slits 33. As shown in FIG. 3, a spring receiver 39 and a hook 36 provided with a vertical groove 37 thereon are provided on the inner center surface of each of the end walls (3*b*) between the pair of vertical slits 33.

Figure 7:
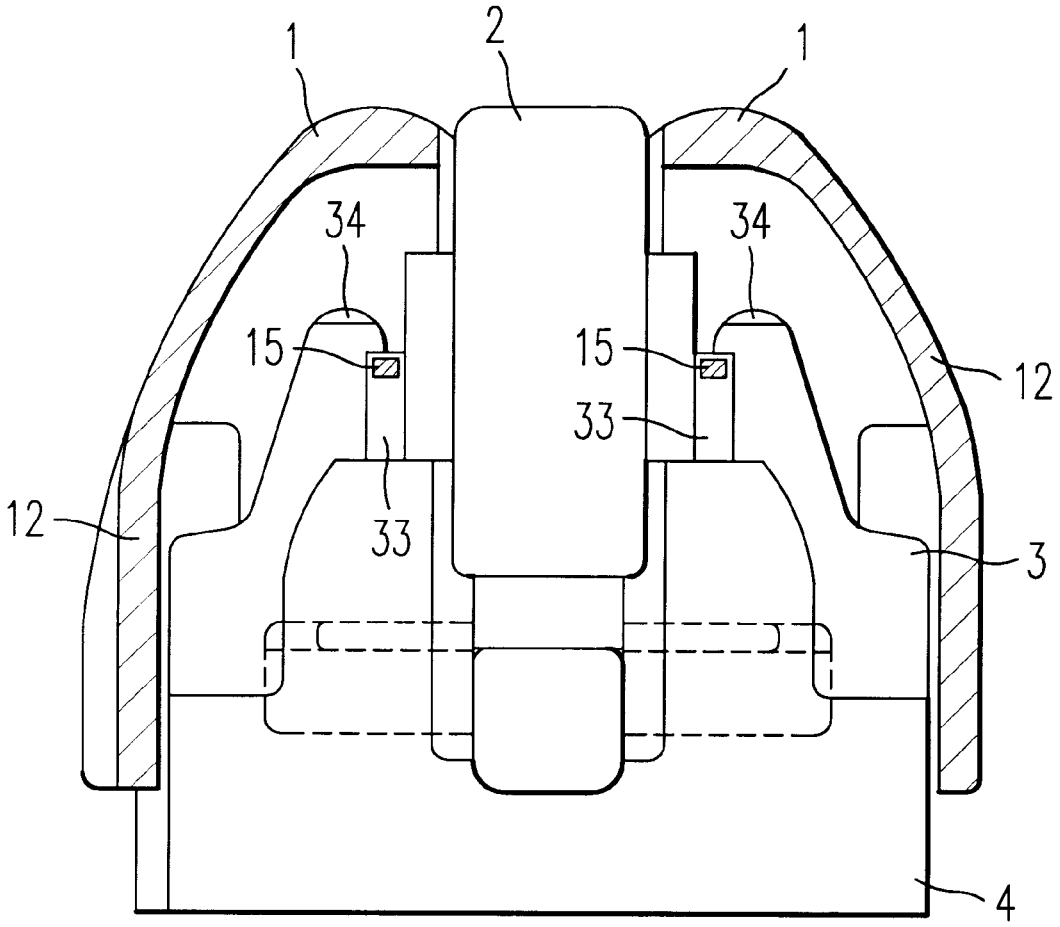
FIG. 7 is a sectional view taken along a line A—A in FIG. 3.

The blade cassette 1 is attached to the retainer 3 by mounting the blade cassette 1 on the retainer 3 and by introducing the engaging members 15 into the slits 33. The outer blade frame 12 of each of the blade cassettes 1, 1 covers the longitudinal wall (3*a*) and the end wall (3*b*) of the retainer 3. When the engaging member 15 is introduced into the slit 33, the engaging member 15 is passed through the hook (34*a*) by elastically deforming the side wall 34, the hook (34*a*) is in a vertical hole 15*a*, and the projections 16 formed inside the end wall 14 of the outer blade frame 12 engage with outer and inner surfaces of the guide wall 35. As shown in FIG. 7, since the engaging member 15 is in the slit 33 and the hook 34 retains the engaging member 15 to be in the slit 33, the blade cassette 1 is retained by the retainer 3 to be movable upwardly and downwardly. When the blade cassette 1 is pushed downwardly, since the float spring portions 32 are in contact with the bottom surface of the outer blade frame 12, the blade cassette 1 is urged upwardly. The blade cassette 1 is guided by a pair of the slit 33 and the engaging member 15 and a pair of the projection 16 and the guide wall 35. Accordingly, the blade cassette 1 is movable in the floating direction (FD) or a vertical direction in FIGS. 2, 3 and 4.

The center blade cassette 2 is attached to the retainer 3 by mounting the center blade cassette 2 on the retainer 3 such that the covers 22 are positioned outside the end walls (3*b*) of the retainer 3. Since the hook 23 of the support 21 is engaged with the hook 36 of the retainer 3 by elastically deforming the hook 23, the center blade cassette 2 is retained by the retainer 3. The center blade cassette 2 is urged upwardly by float springs 45 which are provided between the spring receivers 39 and the supports 21 (see FIG. 6). The vertical rib 24 of the hook 23 slides in the vertical groove 37 which is provided on the hook 36 of the retainer 3, and the vertical rib 25 which is provided inside the cover 22 of the support 21 slides in the vertical groove 38 which is provided on the outer surface of the end wall (3*b*) of the retainer 3. Accordingly, the center blade cassette 2 is movable along the floating direction (FD) or vertical direction in FIG. 3.

The retainer 3 is attached to the head support 4 to position the pushing members 31 outside the end walls of the head support 4 by engaging the hooks 30 with engaging recesses 40 which are provided on the inner surfaces of the end walls of the head support 4.

Figure 8:
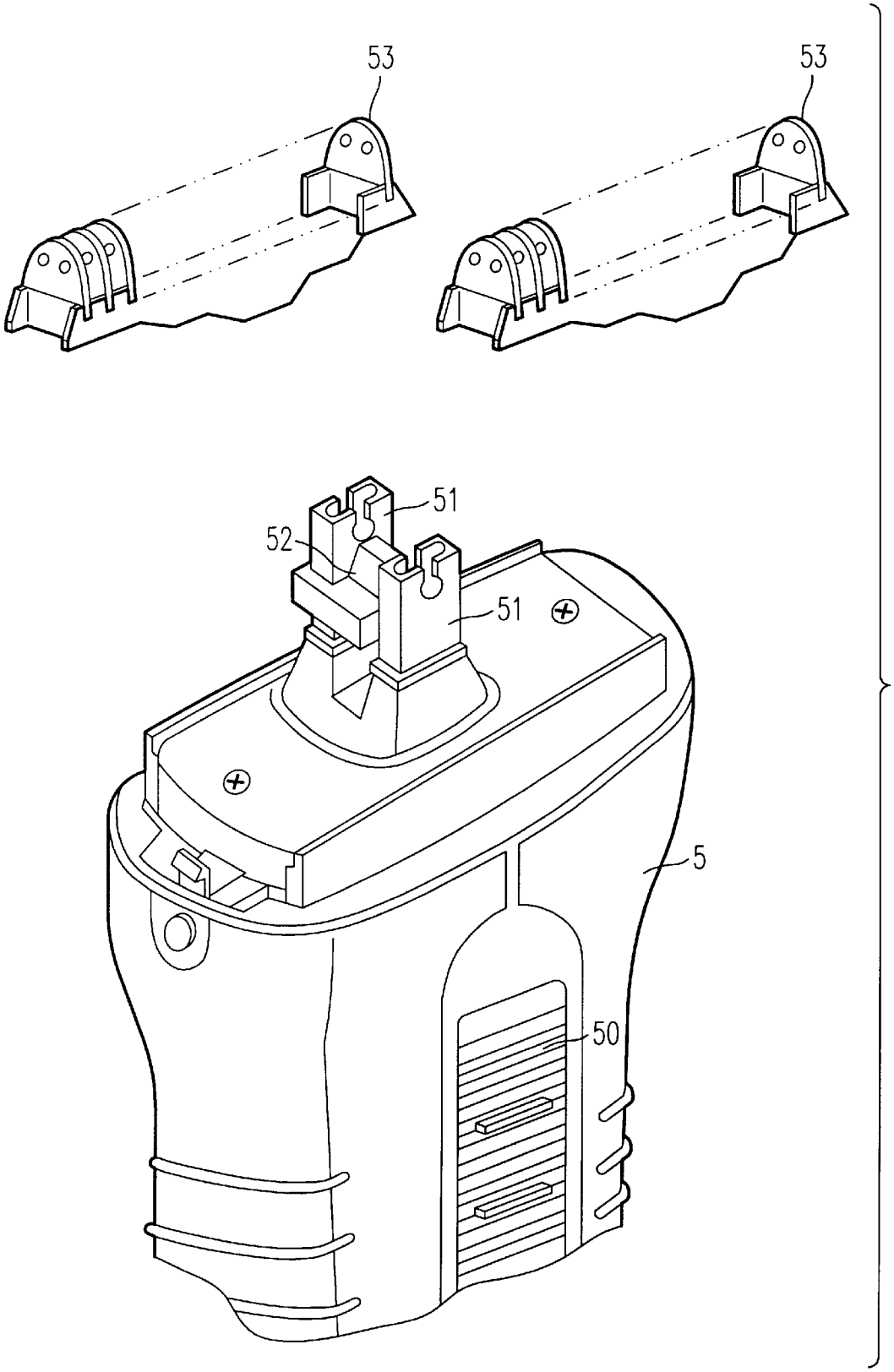
FIG. 8 is an exploded perspective view of a main body and driving members of the reciprocating electric shaver according to the first embodiment of the present invention.

As shown in FIG. 8, the inner blade 53 of the blade cassette 1 is attached to the upper end of each of a pair of driving members 51 which project from the upper end of the main body 5 such that the inner blade 53 is urged upwardly by springs (not shown). The inner blade 53 contacts the inner surface of the outer blade 10 when the blade cassette 1 is attached to the main body 5 via the retainer 3 and the head support 4. The reciprocal motion of the linear motor 6 is transmitted to the inner blade 53 via the driving member 51. Further, since the joint 54 are connected to a driving joint 52 which is provided on one of the driving members 51, the motion of the linear motor 6 is transmitted to the inner blade 55 contained in the center blade cassette 2. The main body 5 includes a switch 50 on its side surface.

Figure 9:
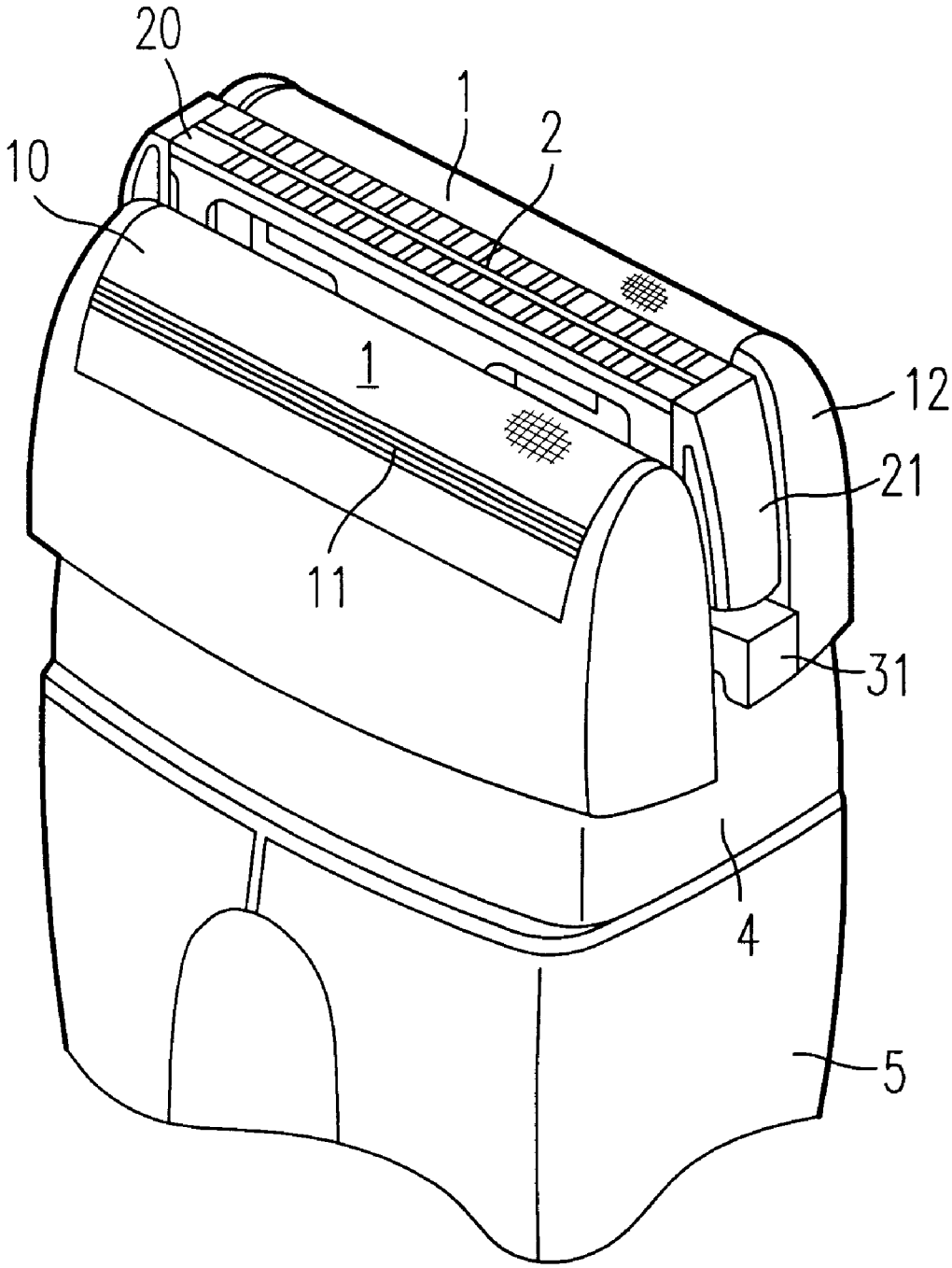
FIG. 9 is a perspective view of the reciprocating electric shaver during a floating operation.
Figure 10C:
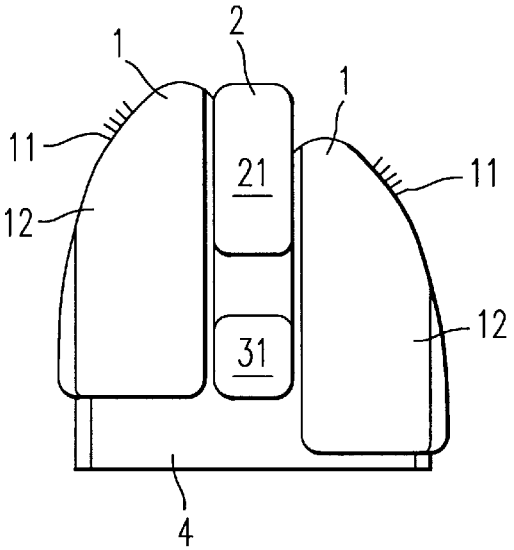
FIGS. 10A–10C are side views of plural blade cassettes during the floating operation.
Figure 10B:
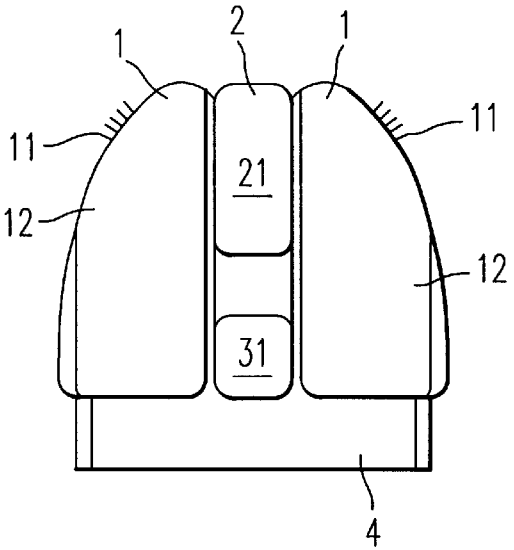
Figure 10A:
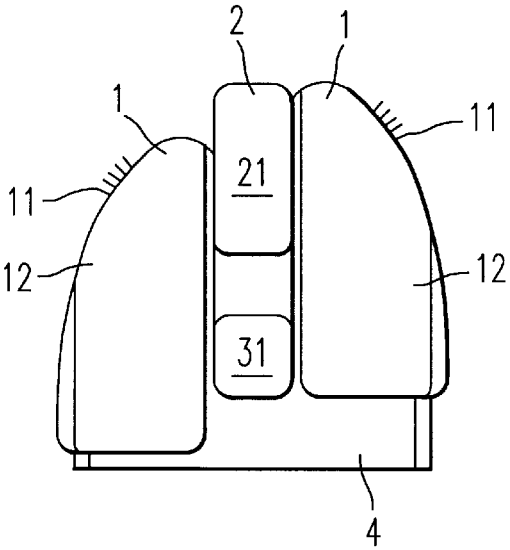
Figure 11:
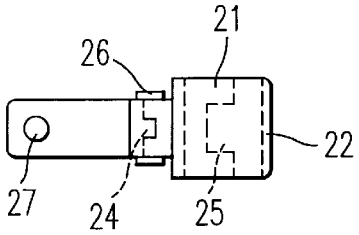
FIG. 11 is a plan view of a support of the reciprocating electric shaver.

As shown in FIGS. 1, 9 and 1OA–10C, the two blade cassettes 1 and 1 and the center blade cassette 2 are independently movable. Accordingly, when the blade cassettes 1, 1 and the center blade cassette 2 are pressed against skin, each of the outer blades 10, 10 and 20 can be in contact with skin. Further, upon shaving while looking at a mirror, the floating situation of each of the outer blades 10, 10 and 20 can be checked, since the blade cassettes 1, 1 and the center blade cassette 2 cover an outer periphery of the retainer. Accordingly, the position of the shaver can be adjusted such that each of the outer blades 10, 10 and 20 can be properly in contact with skin.

The blade cassette 1 is attached to the retainer 3 by introducing the engaging members 15 into the slits 33. Further, the engaging member 15 connects the outer surface of the end of the attachment frame 13 in the longitudinal direction thereof and the inner surface of the end wall 14 of the outer blade frame 12. Namely, the engaging member 15 is supported at two ends thereof, but not only one end thereof. Accordingly, the blade cassette 1 cannot be removed from the retainer 3 even though force is applied to the blade cassette 1 to remove the blade cassette 1 from the retainer 3.

Further, the outer blade frame 12 of the blade cassette 1 has the attachment frame 13 extending along the longitudinal direction thereof. The attachment frame 13 is positioned inside the retainer 3. As shown in FIG. 2, an inner wall 18 of the outer blade frame 12 is positioned inside the retainer 3. Accordingly, the strength of the shaver is reinforced because the retainer 3 is provided between double walls. Namely, the blade cassettes 1, 1 have double wall constructions having outer walls positioned outside an outer periphery of the retainer 3 and inner walls positioned inside an inner periphery of the retainer 3.

Since the position of the lower end of the attachment frame 13 is lower than that of the lower end of the vertical slit 33, hair pieces cut by the blades and remained inside the blade cassette cannot be scattered through the slit 33. Since the pair of projections 16 and 16 sandwiches the guide wall 35, there is no rattle in the driving direction of the inner blade 53. Further, since the blade cassette 1 has a double wall structure, the hair pieces cut by blades and remained inside the blade cassette can be prevented from being scattered outside the blade cassette.

Figure 13:
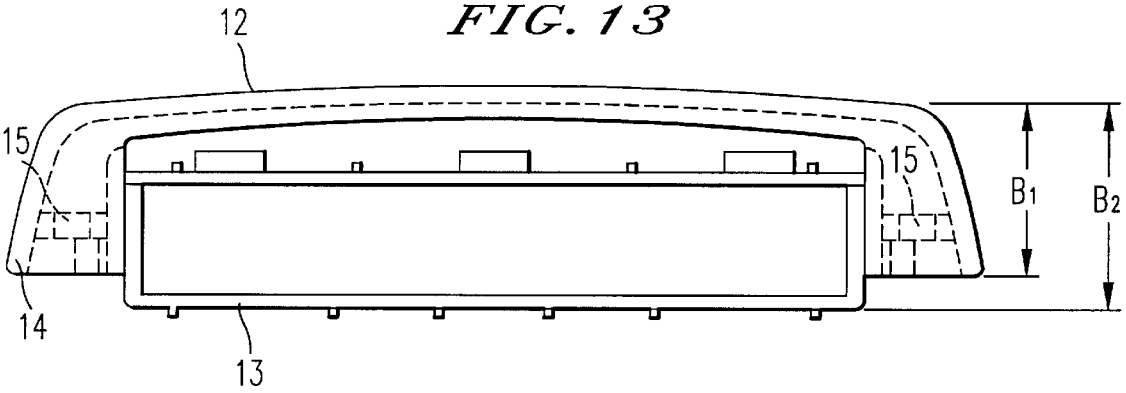
FIG. 13 is a plan view of an outer blade frame of the reciprocating electric shaver.

The vertical rib 25 slides in the vertical groove 38 at the outer upper portion of the retainer 3, and the vertical rib 24 slides in the vertical groove 37 at the inner lower portion of the retainer 3. Accordingly, the center blade cassette 2 is not inclined by a side force. Therefore, the smooth float motion or vertical motion of the center blade cassette 2 can be obtained. Further, as shown in FIG. 13, the end walls 14 of the outer blade frame 12 of the blade cassette 1 has a width B1 smaller than the entire width B2 of the outer blade frame 12. Accordingly, the support 21 for the center blade cassette 2 can have a larger width. Therefore, the center blade cassette 2 can be attached to the retainer 3 more securely.

Figure 14:
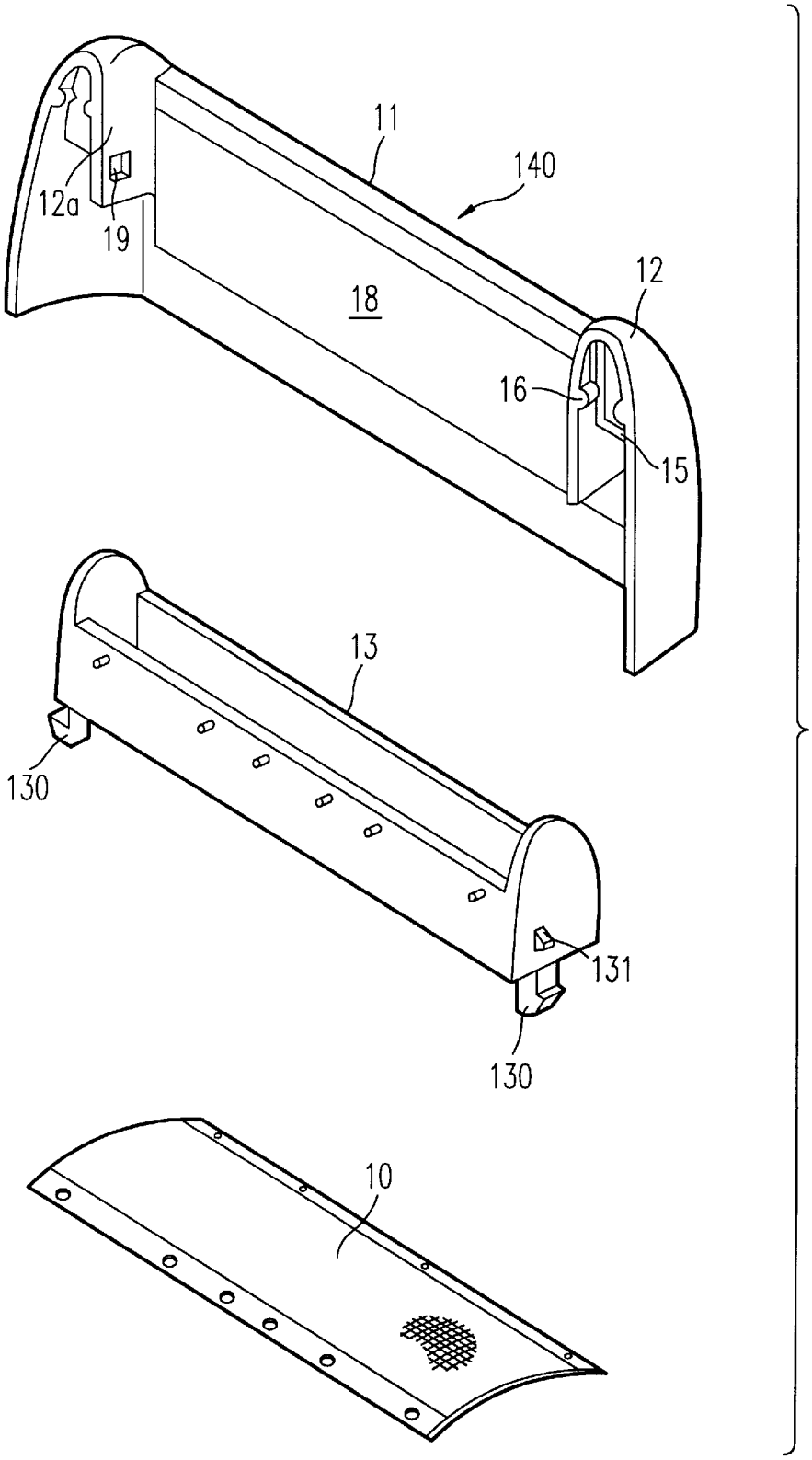
FIG. 14 is an exploded perspective view of an outer blade frame of the reciprocating electric shaver according to a second embodiment of the present invention.

FIG. 14 represents a second embodiment of the present invention. In the second embodiment, the outer blade 12 of the blade cassette 1 includes a frame body 140 and the attachment frame 13 having a rectangular frame shape. The attachment frame 13 is separate from the frame body 140. Engaging projections 131 are provided on the outer surfaces of the both end walls of the attachment frame 13. The frame body 140 has engaging holes 19 on inner walls (12*a*) of the frame body 140. The attachment frame 13 is secured to the frame body 140 by introducing the engaging projections 131 in the engaging holes 19. The attachment frame 13 has releasing projections 130 by which the engaging projections 131 can be released from the engaging holes 19. The frame body 140 and the attachment frame 13 are made from synthetic resin. The attachment frame 13 can be removed from the frame body 140 by elastically deforming the inner walls (12*a*) and the attachment frame 13. Accordingly, the outer blade 10 can be easily replaced by replacing the attachment frame 13 including the outer blade 10. Since the stretching member 11 is provided on the frame body 140, the outer blade 10 and the attachment frame 13 can be easily replaced.

Figure 15:
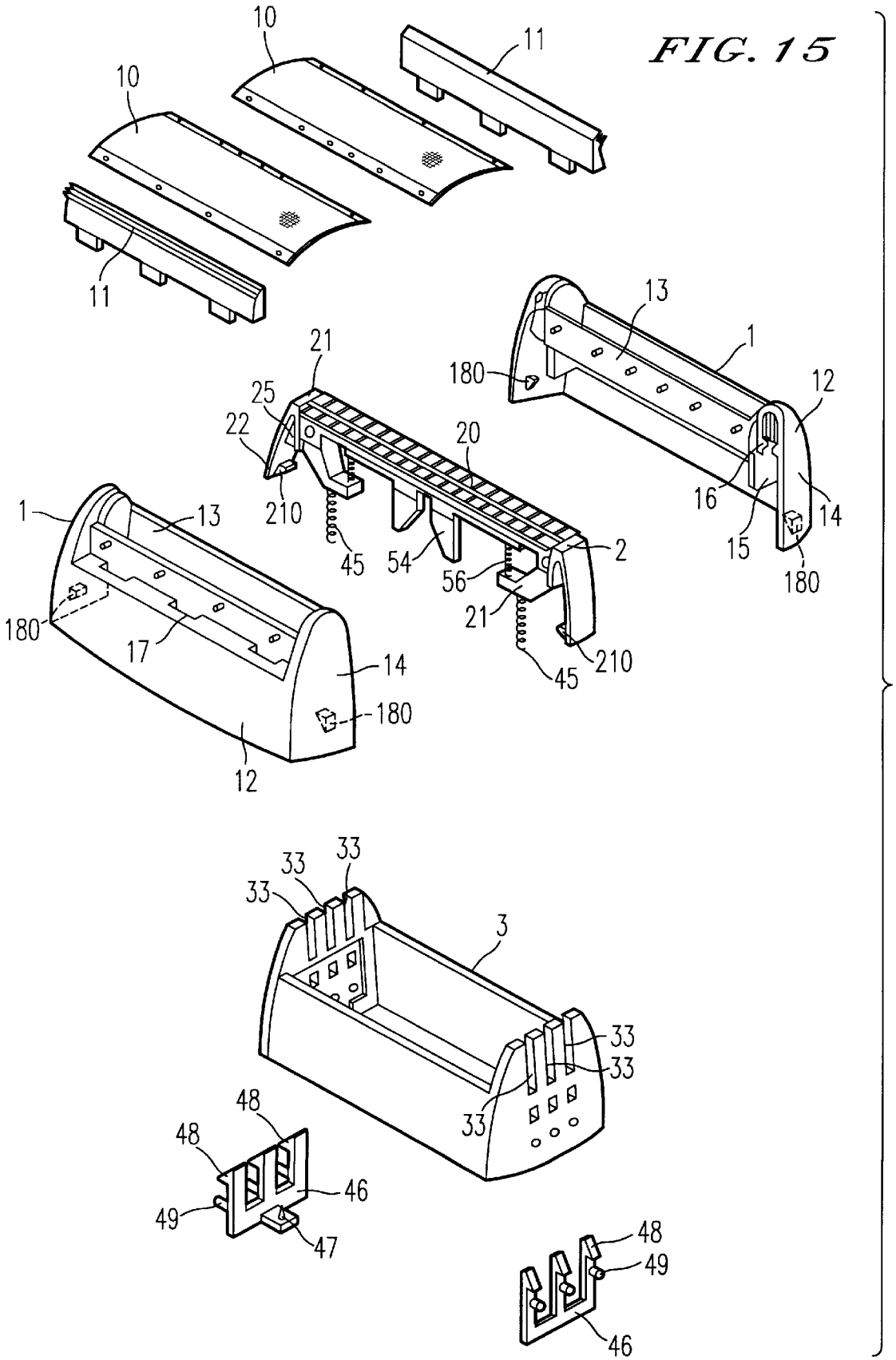
FIG. 15 is an exploded perspective view of the reciprocating electric shaver according to a third embodiment of the present invention.

FIG. 15 represents a third embodiment of the present invention. In the third embodiment, the retainer 3 further operates as the head support 4. Three slits 33 are formed on each of both end walls of the retainer 3. A releasing spring 46 is arranged on the inner surface of each of both end walls of the retainer 3 such that hooks 48 and pushing members 49 protrude from the end wall through the slits 33.

The blade cassette 1 is guided to be movable upwardly and downwardly by the engaging member 15 introduced in the slit 33. The center blade cassette 2 is guided to be movable upwardly and downwardly by the vertical rib 25 of the support 21 introduced in the slit 33. The outer blade 12 of the blade cassette 1 is secured by engaging hooks 180 provided on the inner lower surface of the end wall 14 with the hooks 48 of the releasing spring 46. The support 21 of the center blade cassette 2 is secured by engaging hooks 210 provided on the inner lower surface of the cover 22 with the hooks 48 of the releasing spring 46. By pushing the pushing member 49 to deform the releasing spring 46, the hooks 180 and 48, and the hooks 210 and 48 are disengaged, and thus the blade cassettes 1, 2 can be removed.

According to the third embodiment, the cost of the shaver can be reduced by reducing the number of parts. Since the retainer 3 is directly attached to the main body 5, the shaver's rigidity along the driving direction can be increased. Accordingly, the cutting ability of the shaver can be improved. Further, the blade cassettes 1, 2 can be easily replaced.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. A reciprocating electric shaver comprising:

a main body;

plural blade cassettes, each of said plural blade cassettes including an outer blade and an outer blade frame to which the outer blade is attached, said outer blade frame having engaging members provided inside of said outer blade frame and provided at end portions in a longitudinal direction substantially perpendicular to an arranging direction of said plural blade cassettes; and a retainer via which said plural blade cassettes are attached to said main body, said retainer having a pair of end walls substantially parallel to said arranging direction, each of said pair of end walls including slits extending along a floating direction substantially perpendicular to said longitudinal direction and to said arranging direction, said retainer retaining said plural blade cassettes substantially in parallel with each other by introducing said engaging members into said slits respectively such that each of said plural blade cassettes is independently movable along said floating direction with respect to said main body, said outer blade frame of each of said blade cassettes covering an outer periphery of said retainer.

2. A reciprocating electric shaver according to claim 1, wherein said plural blade cassettes have double wall constructions having outer walls positioned outside the outer periphery of said retainer and inner walls positioned inside an inner periphery of said retainer.

3. A reciprocating electric shaver according to claim 2, wherein said engaging members are formed to connect said inner and outer walls.

4. A reciprocating electric shaver according to claim 2, wherein said inner walls are formed such that lower ends of said inner walls are positioned lower than those of said slits.

5. A reciprocating electric shaver according to claim 1, further comprising:

a center blade cassette arranged between said plural blade cassettes, said center blade cassette having longitudinal end portions, said center blade cassette being retained at each of said longitudinal end portions by two portions of said retainer, one of said two portions being positioned inside each of said end walls and another of said two portions being positioned outside each of said end walls, said two portions being positioned at different heights.

6. A reciprocating electric shaver according to claim 1, further comprising:

a center blade cassette arranged between said plural blade cassettes, a width along said arranging direction at said end portions of said outer blade frame being smaller than that of a center portion of said outer blade frame.

7. A reciprocating electric shaver according to claim 1, wherein said outer blade frame including an attachment frame and a frame body, said outer blade being attached to said attachment frame, said frame body having said engaging member, said attachment frame being removable from said frame body.

8. A reciprocating electric shaver according to claim 7, further comprising:

a stretching member for stretching skin in order to raise hair by stretching skin, said stretching member being provided on said frame body.

9. A reciprocating electric shaver according to claim 1, wherein each of said plural blade cassettes are removable from said retainer.

* * * * *